US011090551B2

(12) United States Patent
Jones

(10) Patent No.: US 11,090,551 B2
(45) Date of Patent: Aug. 17, 2021

(54) CARD SHUFFLER WITH ROTATABLE CARD CAROUSEL

(71) Applicant: Mark Hamilton Jones and Sheryle Lynn Jones Family Trust Dated November 7, 2013, Gardenerville, NV (US)

(72) Inventor: Mark H Jones, Gardenerville, NV (US)

( * ) Notice: Subject to any disclaimer, the term of this patent is extended or adjusted under 35 U.S.C. 154(b) by 0 days.

(21) Appl. No.: 16/856,659

(22) Filed: Apr. 23, 2020

(65) Prior Publication Data

US 2020/0338435 A1 Oct. 29, 2020

Related U.S. Application Data

(60) Provisional application No. 62/837,470, filed on Apr. 23, 2019.

(51) Int. Cl.

| | |
|---|---|
| ***A63F 1/12*** | (2006.01) |
| ***A63F 1/18*** | (2006.01) |
| *A63F 1/06* | (2006.01) |
| *A63F 11/00* | (2006.01) |

(52) U.S. Cl.

CPC ..... *A63F 1/12* (2013.01); *A63F 1/18* (2013.01); *A63F 1/067* (2013.01); *A63F 11/0002* (2013.01)

(58) Field of Classification Search

CPC ..... A63F 1/12; A63F 11/0002; A63F 1/067; A63F 1/18

USPC ..... 273/149 R, 149 P

See application file for complete search history.

(56) References Cited

U.S. PATENT DOCUMENTS

2014/0191470 A1* 7/2014 Jones ..... A63F 1/12 273/149 R

2014/0357340 A1* 12/2014 Pockaj ..... H05B 45/20 463/17

* cited by examiner

*Primary Examiner* — Benjamin Layno

(74) *Attorney, Agent, or Firm* — Dickinson Wright, PLLC

(57) ABSTRACT

A card shuffler with a card carousel includes a random number generator (RNG) and a controller configured to determine a winning outcome for a casino game. The card carousel may include a plurality of slots or sectors, with the slots or sectors corresponding to an outcome of a casino game. The outcome may be determined in a noiseless manner, where the RNG determines the winning slot or sector. The carousel need not rotate to determine an outcome, and the carousel may therefore be fixed or rotatable relative to the base. A card mechanism may be actuated to eject a card from the winning card slot. A plurality of lights may be disposed around the carousel and may be selectively illuminable to indicate the winning sector. The sectors may include display screens with indicia displayed thereon.

22 Claims, 8 Drawing Sheets

CARD SHUFFLER WITH ROTATABLE CARD CAROUSEL

CROSS-REFERENCE TO RELATED APPLICATIONS

This application claims the benefit of U.S. Provisional Patent Application No. 62/837,470, filed Apr. 23, 2019, the content of which is hereby incorporated by reference in its entirety.

TECHNICAL FIELD

This disclosure relates to a card shuffler with a card carousel for use with a casino card game as it relates to the selection and display of a card or outcome using a random number generator (RNG) to determine the outcome of the casino card game.

BACKGROUND

Casino games, such as roulette and craps, are popular games of chance throughout the world. The outcomes of such games are typically determined based on random variance and without the application of player skill or mental process to affect the outcome of the game. Players may place wagers on the outcome, and may be rewarded based on the relative odds of the selected outcome occurring.

For example, in roulette, a rotatable wheel includes a plurality of spaces that are assigned various numbers and colors. A player may wager on the specific number, a range of numbers, or a subset of numbers, and/or the color of the forthcoming outcome. Typically, a ball is introduced onto a rotating board, where the outcome is determined based on where the ball lands. This outcome is generally random.

In craps, outcomes are determined based on the result of two dice that are played. Players may place bets on the expected outcome of the dice. A specific combination of the dice, such as two fours, occurs less often than a sum total of the two dice, such as any combination that results in a total of eight. In roulette, different outcomes have the same odds, but different payouts, but the outcome is still one of a predetermined number of possible outcomes from the rolling of two dice or a ball dropping in a specific area with a fixed #of possibilities. There are 36 combinations of two six-sided dice. There are 38 possible wining numbers in American Roulette (37 in single zero games and 39 in triple zero games).

In some gaming environments, games based on physical objects such as balls or dice being rolled are prohibited. In these environments, a rotating wheel with each of the potential outcomes has been used. However, these wheels typically include a plurality of pegs that spin past a flapper, which can cause an undesirable amount of noise in higher limit parlors. In an open casino environment, the customers love the sound of the flapper. Moreover, the anticipation and excitement involved in the reveal of the outcome is generally increased because the rotating wheel will being slowing as it approaches the final outcome.

Accordingly, improvements can be made to gaming systems and devices for determining game outcomes.

SUMMARY

It is an object of the disclose to provide a card carousel that can determine an outcome of a casino game in a noiseless manner. A sound module can be added if requested based on casino preference.

It is an object of the disclose to provide a card carousel that can be used in a variety of casino games.

It is an object of the disclosure to provide a card shuffler having (true) randomly determined outcomes.

It is an object of the disclose to provide a card shuffler that can replace outcomes determined by a ball or dice or tiles.

In one aspect, a card shuffler for use with a casino game is provided. The card shuffler includes a carousel for use with the casino card game, a plurality of sectors of the carousel configured for being selected as an outcome of the casino game; a random number generator (RNG) configured for determining a winning sector from the plurality of sectors; a display mechanism for identifying the winning sector determined by the random number generator; and a controller in communication with the RNG and configured to actuate the display mechanism to identify the winning sector.

In one aspect, each sector includes a slot for retaining a card displaying an outcome of the casino game.

In one aspect, each slot is configured to eject a card disposed therein for displaying the card.

In one aspect, the card shuffler includes at least one a card mechanism configured to eject the card from the slot associated with the winning sector.

In one aspect, the at least one card mechanism is fixed in place relative to a base, and the carousel is rotatable relative to the base in response to signals from the controller to align the winning sector with at least one card mechanism.

In one aspect, at least one card mechanism comprises a plurality of card mechanisms corresponding to each of the plurality of sectors and selectively controllable by the controller.

In one aspect, the at least one card mechanism rotates relative to the carousel to align the at least one card mechanism with the winner sector.

In one aspect, the card shuffler includes a base, and the carousel is fixed relative to the base.

In one aspect, the card shuffler includes a base, and the carrousel is rotatable relative to the base.

In one aspect, the card shuffler includes a plurality of lights disposed around a perimeter of the carousel.

In one aspect, each sector includes at least one corresponding light of the plurality of lights.

In one aspect, the light corresponding to the winning sector is selectively illuminable by the controller.

In one aspect, the sector includes a display screen.

In another aspect, a card shuffler for use with a casino game is provided. The card shuffler includes a carousel for use with the casino card game, a plurality of slots of the carousel configured for receiving a card therein; a random number generator (RNG) configured for determining a winning slot from the plurality of slots; a display mechanism for identifying the winning slot determined by the random number generator; and a controller in communication with the RNG and configured to actuate the display mechanism to identify the winning slot; wherein a winning outcome of the carousel is determinable without a flapper and peg arrangement.

In one aspect, a card tray is disposed adjacent the carousel, the card tray configured to receive a card extended out from the slot, wherein the card tray includes an opening aligned with a corresponding slot of the carousel.

In one aspect, a winning slot of the carousel is determinable in a noiseless manner.

In another aspect, a method of determining an outcome of a casino game is provided. The method includes providing a carousel having a plurality of sectors, wherein the carousel is operably connected to a random number generator and a controller; activating the random number generator via the controller; determining a winning sector of the carousel via the random number generator (RNG); visibly identifying, via signals from the controller, the winning sector of the carousel determined by the RNG; wherein each sector includes at least one of a display screen for displaying an indicia of an outcome of the casino game or a slot for holding a card having an indicia corresponding to an outcome of the casino game.

In one aspect, the method includes rotating the carousel relative to a fixed base.

In one aspect, the carousel remains stationary.

In one aspect, the method includes activating a card mechanism aligned with the winning sector and ejecting a card from a slot within the winning sector.

In one aspect, the method includes rotating the carousel relative to the card mechanism to align the card mechanism with the winning sector.

In one aspect, the method includes rotating the card mechanism relative to a stationary carousel to align the card mechanism with the winning sector.

In one aspect, each sector includes a corresponding card mechanism, wherein the controller activates the card mechanism associated with the winning sector.

In one aspect, the method includes illuminating a light corresponding to the winning sector.

BRIEF DESCRIPTION OF THE DRAWINGS

The drawings described herein are for illustrative purposes only of selected aspects and not all possible or anticipated implementations thereof and are not intended to limit the scope of the present disclosure.

DETAILED DESCRIPTION

In the following description, details are set forth to provide an understanding of the present disclosure. In some instances, certain systems, structures and techniques have not been described or shown in detail in order not to obscure the disclosure.

In general, the present disclosure relates to a card shuffler 10 with a card carousel C for use with a casino card game as it relates to the selection and deployment of a card 16 using a random number generator (RNG) 24 to determine the outcome of the casino card game, or a portion thereof.

Figure 1:
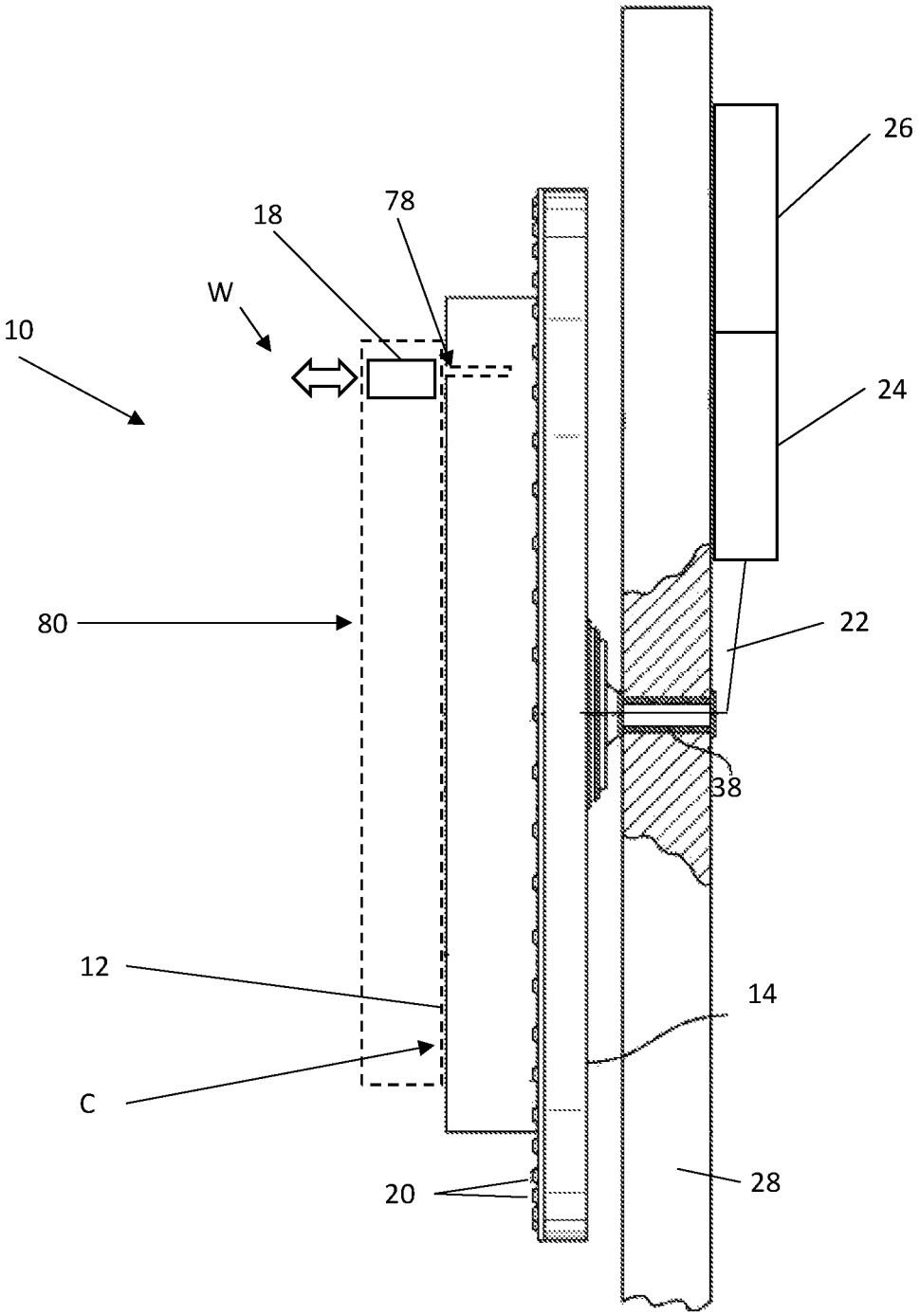
FIG. 1 is a side view of a card shuffler according to aspects of the disclosure.

An example of the card shuffler 10 with a card carousel device C according to aspects of the disclosure is shown in FIG. 1. The device may be used by a dealer (not shown) of a casino card game as will be described in conjunction with one or more exemplary embodiments. However, the specific example embodiments disclosed are merely provided to describe the inventive concepts, features, aspects and objectives with sufficient clarity to permit those skilled in this art to understand and practice the disclosure.

The present disclosure provides for a card shuffler 10 with a card carousel C for use with casino card games including, but not limited to, "Big Six" and "Money Wheel" where the shuffler rotates about a horizontal axis of rotation. These exemplary casino card games are described in U.S. Pat. Nos. 8,505,919 and 8,695,981 and are hereby incorporated by reference in their entireties. It should be understood that other casino card games may utilize the card shuffler 10 with a card carousel C described herein.

The present disclosure provides for a card shuffler 10 with a card carousel C ("card shuffler") including a front face 12 and a back face 14. The front face 12 includes a plurality of card slots 16 or outcome sectors, wherein each card slot/sector 16 can receive a playing card, token, ticket, or other suitable gaming implement. The front face 12 can also include a plurality of lights 20 with at least one light 20 assigned to each card slot/sector 16. The carousel C also includes a card tray 80 disposed above the plurality of card slots 16 and configured to receive a card extended from one of the card slots 16 when selected by the RNG 24. The lights 20 may be configured to flash and/or otherwise indicate the card selected by the RNG 24 (as well as other cards not selected by the RNG).

The present disclosure also provides for a casino card game wherein the shuffle (card selection) is a random number generator (RNG) 24. The RNG 24 may be connected to a controller 26 operated, for example, by a dealer. Alternatively, the RNG 24 itself may be operated by a dealer. The RNG 24 can be included in a computer as software (an application) or the RNG 24 can be a stand-alone device including a processor and memory, for example. The RNG 24 may also be connected to the plurality of lights 20. The dealer may operate the card shuffler 10 using the controller 26 to cause the RNG 24 to randomly generate a number assigned to a particular card or slot/sector 16 of the plurality of cards included in the casino card game. At or about the same time, the carousel C of the card shuffler may rotate in either a clockwise or counter-clockwise direction, however it is contemplated that the card shuffler 10 may be configured to rotate in other rotational directions, such as for a three-dimensional object (sphere or cylinder), or in a digital (electronic) format.

In one aspect, the carousel C may be fixed in place and may not rotate. In this aspect, the winning slot/sector 16 of the carousel C may be selected by the RNG 24 and indicated via a light 20 or another indicator. In one aspect, the indicator of the winning sector 16, such as an arrow or "flapper" or the like, may rotate around the fixed carousel C and be controlled to stop at the winning slot/sector 16 as determined by the RNG 24. Because the outcome may be determined by the RNG 24, actual rotation of the carousel C is unnecessary for determining and displaying the winning outcome, thereby allowing for the carousel C to remain fixed and stationary.

In one aspect, once a number and its respective card is randomly chosen by the RNG 24, the rotation of the carousel C stops at a predetermined position relative to the card tray 80 above the carousel and the card selected by the RNG 24 is pushed or ejected (elevated or shifted) from its card slot 16 in the carousel C into the card tray 80 by a card mechanism 78 within the carousel C. The card mechanism 78 may be a push arm that serves to lift the card and then allow it to return to its slot 16 after all wagers have been resolved based on the indicia of the raised card.

The card mechanism 78 may be a single push arm for a rotatable carousel C or a plurality of mechanisms 78 and push arms for a stationary carousel C (one push arm for each card slot and card). For example, the card mechanism 78 may be disposed at a fixed location, and the carousel C may be rotated in response to the RNG 24 determining the winning slot 16 such that the winning slot 16 becomes aligned with or disposed adjacent the card mechanism 78 to display the card from the winning slot 16. In the case of the stationary carousel C, each slot may have an associated card mechanism 78, and upon determining the winning slot 16, the card mechanism 78 associated with the winning slot 16 may be actuated.

In another aspect, in the case of a stationary carousel C, the card mechanism 78 may be rotated relative to the fixed carousel C, and the card mechanism 78 may be actuated upon reaching the location of the winning slot 16. For example, in response to the RNG 24 determining a winning slot 16, the card mechanism 78 may be controlled to be positioned at the winning slot 16, and then the push arm may be actuated to reveal the card.

In another aspect, in the case of a stationary carousel C, the card mechanism 78 may be disposed on a back side or underside of the carousel C that is not visible to the players, thereby creating an anticipation of the location of the winning slot that will produce and display the card. Players will not know or be able to predict which of the cards will ultimately be selected and displayed.

The card mechanism 78 may also physically return the card to its slot. It will be appreciated that a variety of suitable card mechanisms 78 may be employed. The card mechanism 78 may include a sensor or other detecting device that is triggered by movement of the card or the card mechanism 78 (either extending the card out of the slot 16 or retracting the card in the slot 16). The card may be pushed up randomly from the top of the carousel C or be in a fixed position in the carousel C. Put another way, for a rotating carousel C, the carousel C may be in any orientation when the card is pushed up, or the carousel C may be rotated to specific orientation such that the winning card is pushed up at the same location relative to the carousel (such as adjacent the dealer's position).

The dealer may then retrieve the selected or winning card from the card tray 80, display it to the players of the casino card game, and settle all wagers. The dealer may also display it to an imaging device such as a camera in that one or more images of the winning card may be displayed on one or more screens. This configuration may be beneficial if the casino card game is being held in a large room with many players. The dealer then returns the winning card to the card tray 80 and into the empty card slot 16 in the carousel to complete the casino card game.

The rotation of the carousel C of the card shuffler (or the rotation of the card mechanism 78 relative to a fixed carousel) is generally noiseless and therefore allows the casino card game to be played in casino gaming environments where the noise from a card shuffler with a flapper/peg configuration may be undesirable. The card shuffler 10 can be configured to operate at a desired pace. In other words, the length of time for the card shuffler 10 operation (a cycle) can be adjusted to increase player suspense (longer times for chosen card to be selected) or to improve cycle time (shorter times to increase game play).

In the case of a stationary card carousel C, the lights 20 disposed around the carousel C adjacent the various slots 16 may be controlled to be illuminated in sequence or animated in such a way so as to appear to be rotating around the perimeter of the fixed and stationary carousel C. The lights 20 may stop "rotating" at the location of the winning slot 16 that is determined by the RNG 24. The colors of the lights 20 may also be controlled to indicate the winning slot 16 relative to the losing slots 16. Upon identifying the winning slot 16, the dealer may remove the card from the slot 16 and display the card, similar to the above. The card mechanism 78 may present the card for the dealer to select, or the dealer may retrieve the card from the slot 16 without the use of a card mechanism 78.

Figure 2:
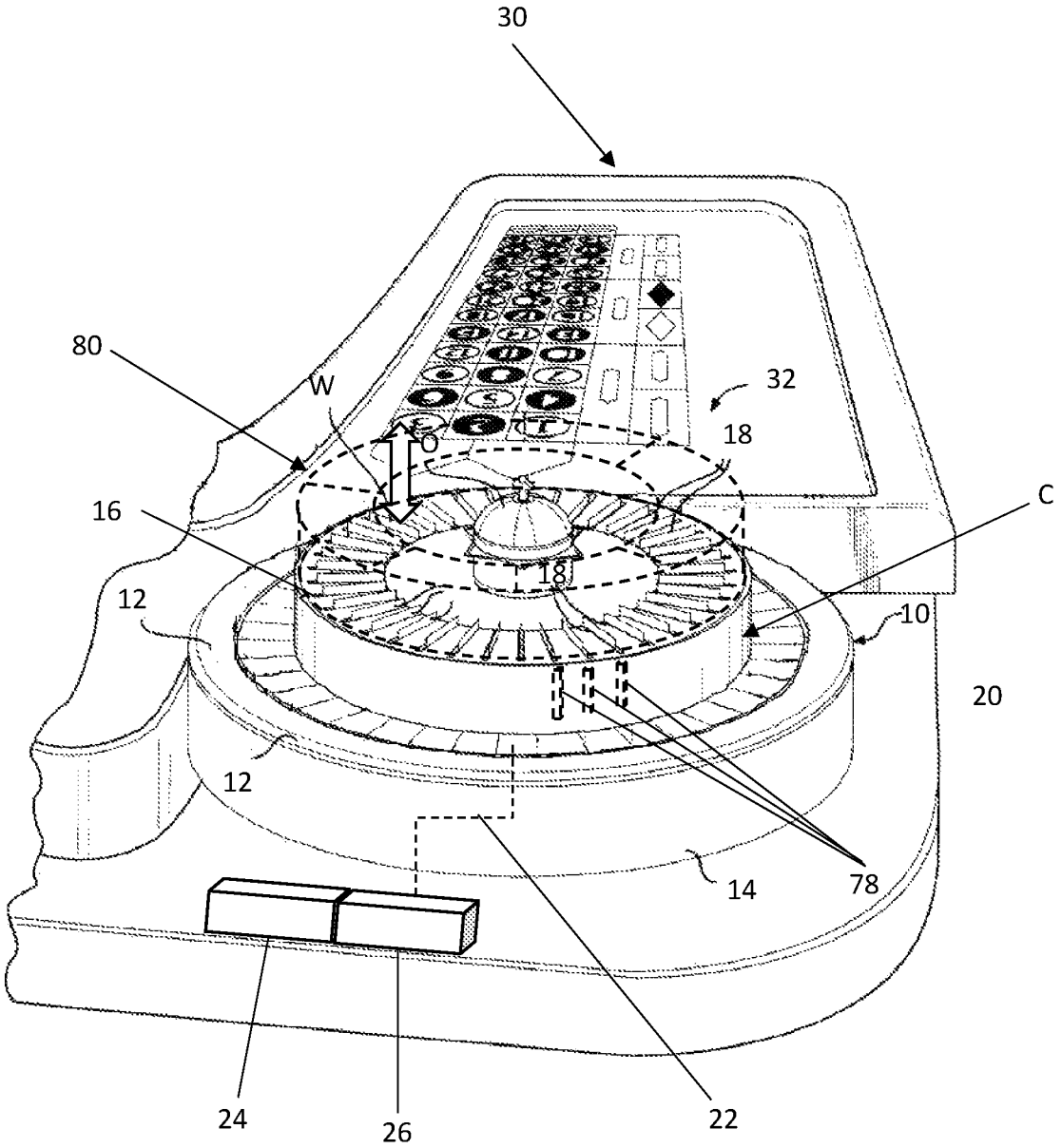
FIG. 2 is a perspective view of the card shuffler shown in FIG. 1, wherein the card shuffler is associated with the playing surface of a casino card game, according to aspects of the disclosure.
Figure 3:
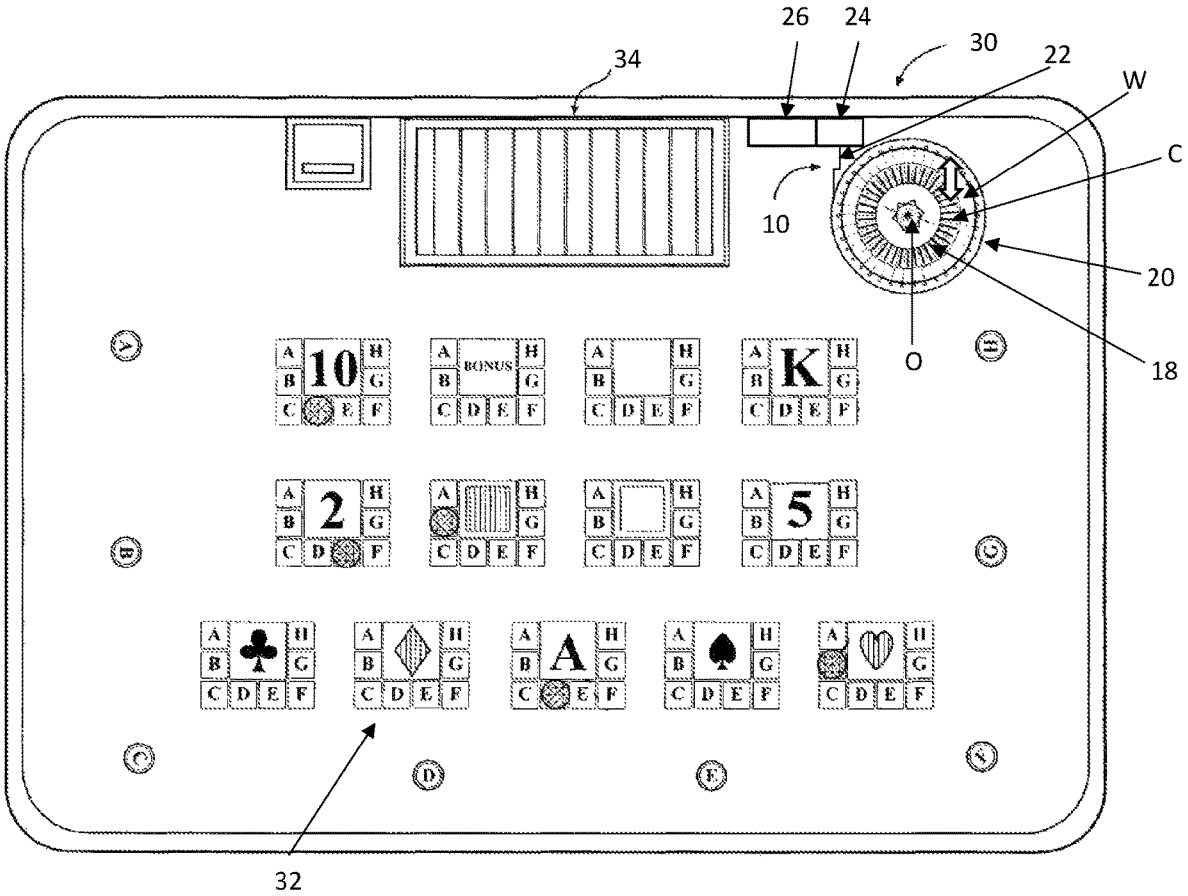
FIG. 3 is an exemplary playing surface layout for a physical table including the card shuffler shown in FIGS. 1-2, according to aspects of the disclosure.

Referring to FIGS. 1-3, a non-limiting example of a card shuffler 10 is shown and includes a carousel C having a front face 12, a back face 14 disposed behind the front face 12, a plurality of card slots 16 to hold a plurality of cards 18. FIG. 1 illustrates the carousel C mounted in a vertical arrangement, with FIGS. 2 and 3 illustrating the carousel oriented in a generally horizontal manner. It will be appreciated that the orientation of the carousel may vary, as determining the winning outcome is not dependent on gravity. A plurality of lights 20 may be disposed about the perimeter of the front face 12. The lights 20 can be configured as light-emitting diodes (LEDs), for example. In other embodiments, the lights 20 can be configured as light bulbs extending from the front face 12 or be contained within the front face 12, such as in recessed compartments covered with lenses.

In the non-limiting example of the card shuffler 10 shown in FIGS. 1-3, the card shuffler 10 can include an electrical connection 22 and a random number generator (RNG) 24. The card shuffler 10, the electrical connection 22 and the RNG 24 may also be electrically connected to a controller 26 that can be operated by a dealer or remotely from another location (such as elsewhere within the gaming casino). The card shuffler 10 may be disposed on a physical table 30 including a playing surface 32 and a chip tray 34 (see FIG. 3).

The card shuffler 10 may also include a base 28 that includes a pin 38. The base 28 and the pin 38 may be configured to permit the carousel C of the card shuffler 10 to rotate. Additionally and alternatively, the carousel C may include a rotational mechanism (not shown) that may permit the carousel C to rotate without the base 28 or the pin 38. The pin 38 is fixed to the carousel C in this arrangement, such that rotation of the pin 38 and carousel relative to the base 28 allows the carousel C to rotate. In another aspect, the pin 38 may be fixed to the base 28 and the carousel C may rotate relative to the fixed base 28 and pin 38. In the case of a stationary carousel C, the carousel C may be fixed to the base 28, and the pin 38 may permit rotation of the other components that may rotate relative to the base 28 or the carousel C, or the pin may be omitted.

Figure 6:
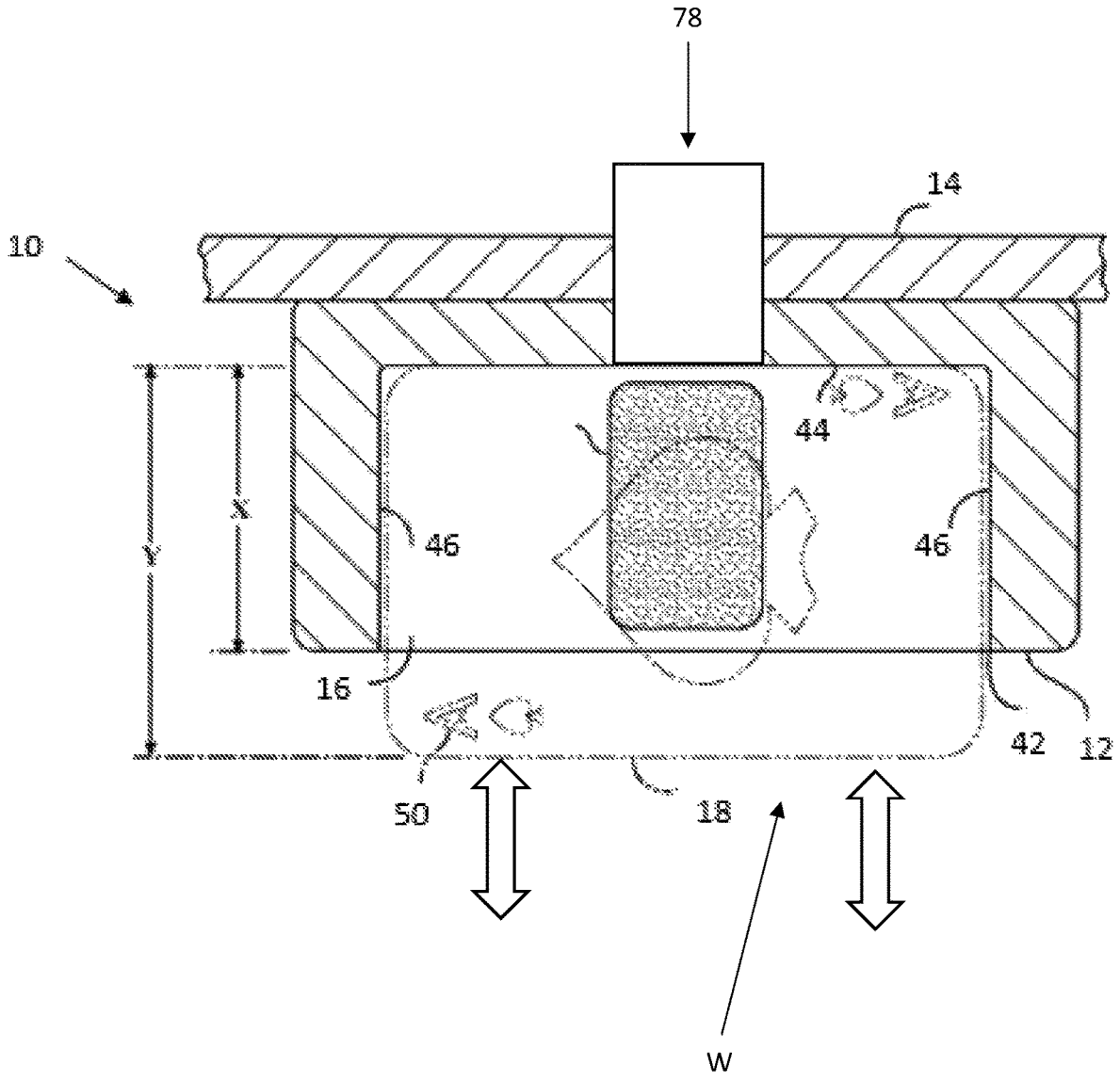
FIG. 6 is a cross-sectional view of a card slot of the card shuffler as shown in FIGS. 1-3 with card shown therein in phantom.

The card shuffler 10 may also include a card tray 80 disposed adjacent to the carousel C. The card tray 80 may be clear (transparent) and may include one or more slots or openings configured to receive one or more cards 18 when the cards 18 are ejected or pushed out of the slots 16. The card tray 80 may be fixed relative to the rotatable carousel C, such as by pin 38 of base 28. Additionally and alternatively, the card tray 80 may rotate with (and be connected to) carousel C such that card tray 80 may include the same number of card slots 16 as carousel C and the slots of the card tray 80 may be fixed relative to the card slots 16 of the carousel C. The card tray 80 may be configured to receive a card raised by one or more card mechanisms (e.g., push arms) 78 disposed within the carousel C. The card mechanism may be electrically connected to the RNG 24 or the controller 26 using the electrical connection 22. The card mechanism 78 may be configured to push (elevate) the winning card (selected by the RNG or the controller 26) into the card tray 80 for retrieval by the dealer. The card mechanism 78 may also be configured to retract (pull in) the winning card once the winning card is replaced in the card tray 80 of the carousel C (such as after a casino card game is complete). The card mechanism 78 may work in conjunction with (or replace) a friction element 40 (see FIGS. 4B, 6).

According to an aspect of the disclosure, during play using the card shuffler 10 as shown in FIGS. 1-3, the dealer can request wagers (bets) from one or more players (not shown) disposed around the physical table 30. The players may place their wagers on the playing surface 32 corresponding to their location and the possible outcomes of the particular game using the card shuffler 10. It will be appreciated that players may place wagers in other manners made available by the operator of the casino game. It is important to note that the rotation of the carousel C, or the card mechanism 78 relative to the stationary carousel C, operates noiselessly. In contrast, other casino card games with a card shuffler including pegs and one or more flappers may entice players by having the dealer D rotate (i.e., spin) the card shuffler, causing the flappers to make noise due to the flappers striking the pegs during rotation of the card shuffler. This flapper noise may be undesirable in some casino gaming situations, such as high-end casino gaming environments. According to another aspect, the carousel C may be manually rotated and may communicate with a flapper to slow rotation of the carousel through pulsating interaction with a plurality of detent structures.

Once the players have placed wagers on the playing surface 32 of the physical 30, the dealer may operate the RNG 24 using the controller 26. According to an aspect, the RNG 24 generates a random number representing a card contained in one (or more) of the card slots 16 of the card shuffler 10. The random number representing a card may be a random number representing a specific card slot 16, rather than a specific outcome printed on the card. As the cards 18 are disposed in the card slots 16, the selection of a card is based on the selection of the card slot 16. Accordingly, the cards 18 may be dispersed throughout the card slots 16 randomly or ordered, and such dispersal will not affect the integrity of the random selection produced by the RNG 24. After a predetermined time has elapsed, or by command of the dealer using the controller 26, the RNG 24 or the controller 26 will determine the winning card W or slot 16, and the winning card W contained within the winning slot 16 is pushed from the winning card slot 16 by the card mechanism 78 (e.g., push arm) into the card tray 80 for retrieval by the dealer.

As described above, the card 18 may be pushed from the slot 16 after the time has elapsed in a number of different ways. A selected one of multiple dedicated card mechanisms 78 may be activated, the carousel C may be rotated such that the selected slot 16 is aligned with the fixed card mechanism 78, or the card mechanism 78 may be rotated to be aligned with the selected slot 16 of a stationary carousel C.

After the RNG 24 and the controller of the card shuffler 10 selects the winning card W slot 16 on the card shuffler 10, the dealer may remove the winning card W from its card slot 16 and show it to the player(s) of the casino card game situated around the physical table 30. The dealer may then settle any wagers relating to the winning card W (pay chips to winning players or retrieve chips from losing players). The dealer may then re-insert the winning card W into the card tray 80 and the respective card slot 16 of the carousel C of the card shuffler 10, completing a game of the casino card game. The dealer may then reset the casino card game using the RNG 24 or the controller 26. The display of the winning card W may also be performed without dealer interaction, by extending the winning card W such that it is viewable by the dealer, and automatically retracting the card back into the slot 16. In this aspect, the dealer does not need to manually remove the card W and re-insert the card W.

Figure 4A:
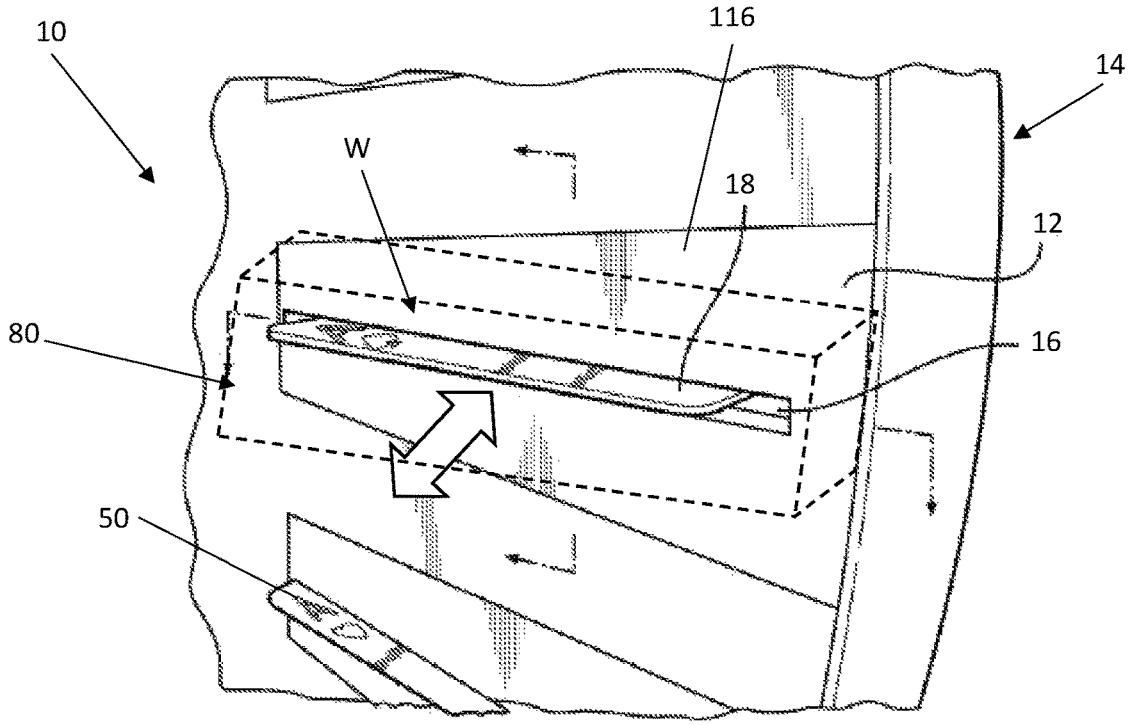
FIG. 4A is a partial close-up view of the card shuffler shown in FIGS. 1-3, according to aspects of the disclosure.

According to an aspect of the disclosure, the card slots 16 and the cards 18 of the carousel C of the card shuffler 10 may be configured electronically, such as that each card slot 16 and card 18 may be replaced by an electronic display 116 (illustrated for example as an alternative in FIG. 4A.) (e.g., a LED video display). As a result, the card slots 16 and cards 18 may be selectively visible as images, such as during a casino card game while at other times other images may be displayed in the electronic displays 116 (e.g., casino name, messages to players, other images). Thus, when the RNG selects the winning card W location, the electronic display 116 in the winning card W location may be configured to display (draw attention to by illumination) the winning card W and/or a marker (flag) designating the winning card W may be raised. Simultaneously or near so, the other displays 116 at non-winning locations may go dark or display other images such as logos of the casino or the casino game being played (roulette, craps). By this configuration, the type of game played on the card shuffler 10 may be changed very quickly between, for example, a roulette and a card game. For example, rather than a card having a roulette outcome printed thereon, the electronic display may simply display the roulette outcome directly. Or, the electronic display 116 may display the various possible dice rolls for a pair of dice that may be used for a craps game.

While the electronic display version of the carousel C may be used in a manner such that the winning outcome is illuminated or otherwise flagged or indicated, the carousel C may also be rotated to position the winning display 116 at a specific location, as described above. For example, an arrow or other indicator may be positioned at a specific location on the base 28, and the carousel C may be rotated to position the winning display 116 adjacent the arrow. In the case of the display 116, the carousel C may also be stationary, as described above, and the above described flag or other indicator may be rotated or positioned relative to the fixed carousel C. Alternatively, a flag, arrow, or other indictor may be positioned at each of the outcomes, and the indicator associated with the winning outcome may be the one to be activated, similar to the card mechanism 78 described above. For instance, light 20 adjacent the winning outcome 116 may be illuminated to indicate the winning display 116.

Referring to FIG. 2, the card shuffler 10 is shown disposed in a physical table 30. The card shuffler 10 includes the carousel C having the front face 12, the back face 14, the plurality of card slots 16 to hold the plurality of cards 18. The carousel C also includes the card mechanism(s) 78 for elevating and/or retracting the cards 18 into their card slots 16 and an ornament O. The card tray 80 may be disposed above the carousel C and may be configured to be fixed to carousel C to rotate with carousel C or be fixed such that carousel C rotates relative to the card tray 80. In the case of a stationary carousel C, the card tray 80 may also remain stationary, or the card tray 80 may be made to rotate relative to the fixed carousel C.

It should be understood that while the card shuffler 10 is shown as circular, the card shuffler 10 may be represented in a plurality of other shapes and sizes. This disclosure contemplates card shufflers accordingly and the illustrative examples of card shufflers described herein are only exemplary and not limiting. According to an aspect of the disclosure, the lights 20 of the card shuffler 10 are connected via an electrical connection 22 to an RNG 24 and a controller 26. The electrical connection 22 may be configured to pass through attachment pin 38 that secures the card shuffler 10 to the base 28 (see FIG. 1).

Referring now to FIG. 3 another aspect of the disclosure is shown. The card shuffler 10 includes the carousel C having the front face 12, the back face 14, the plurality of card slots 16 to hold a plurality of cards 18, the plurality of lights 20 (including the light(s) 20 denoting the winning card W), the card tray 80 and the ornament O. The card shuffler 10 also includes the electrical connection 22 between the card shuffler 10, the RNG 24, and the controller 26. The card shuffler 10 may be disposed horizontally on the physical table 30 adjacent to or within the playing surface 32. The playing surface 32 may include the controller 26 for operation by the dealer and the chip tray 34.

FIG. 3 illustrates an overhead (top) view of the card shuffler 10 disposed on the playing surface 32 of the physical table 30. The electrical connection 22 between the card shuffler 10, the RNG 24, and the controller 26 is shown on the playing surface 32 but may be disposed beneath the playing surface 32 of the physical table 30, with the electrical connection 22 passing through the playing surface 32 of the physical table 30 to the card shuffler 10. The electrical connection 22 may be configured as a wire, cable, or a set of wires and cables, for example. Additionally, and alternatively, the electrical connection 22 may be a wireless connection, such as Wi-Fi or Bluetooth®.

Referring now to FIGS. 4A-6, portions of the card shuffler 10 are shown including the front face 12, the back face 14, the card slots 16, the cards 18 disposed at least partially within the card slots 16, the carousel C, the card mechanism (s) 78, and the card tray 80.

According to an aspect of the disclosure, the card slots 16 may include one or more friction elements 40 that may be configured to secure cards 18 at least partially within the card slots 16. It should be understood that the card slots 16 may be configured to receive some or all of the cards 18 such that it may be difficult or not possible for the cards 18 to be visible (other than their edges) while within card slots 16. Additionally, and alternatively, the friction elements 40 may include features of (or be a substitute for) the card mechanisms (e.g., push arms) 78. Thus, the friction elements 40 may hold, extend and/or retract the cards 18 in the card slots 16 in place of separate card mechanism(s) 78. The friction elements 40 may include mechanical and/or electrical components to hold, extend and/or retract the cards 18 from the card slots 16 and the card tray 80, such as when a winning card W is selected or when the dealer is changing the cards 18 from a first game (such as roulette) to a second game (such as craps). It will be appreciated that a variety of other suitable retention mechanism may be employed.

Figure 4B:
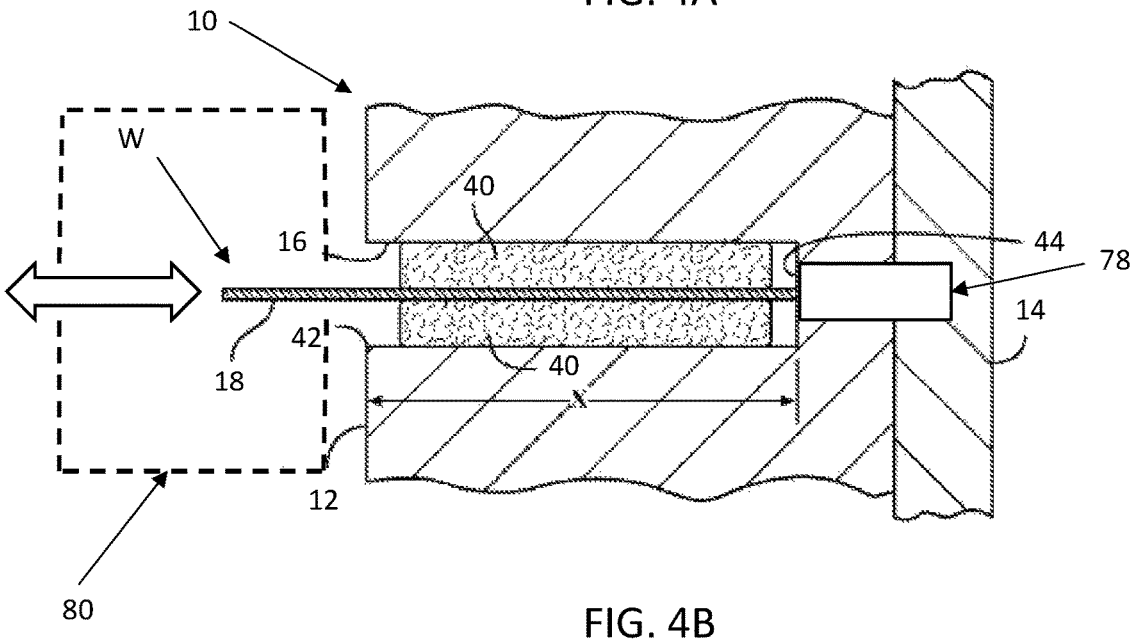
FIG. 4B is a partial, close-up sectional view of the card shuffler shown in FIGS. 1-3, according to aspects of the disclosure.
Figure 5:
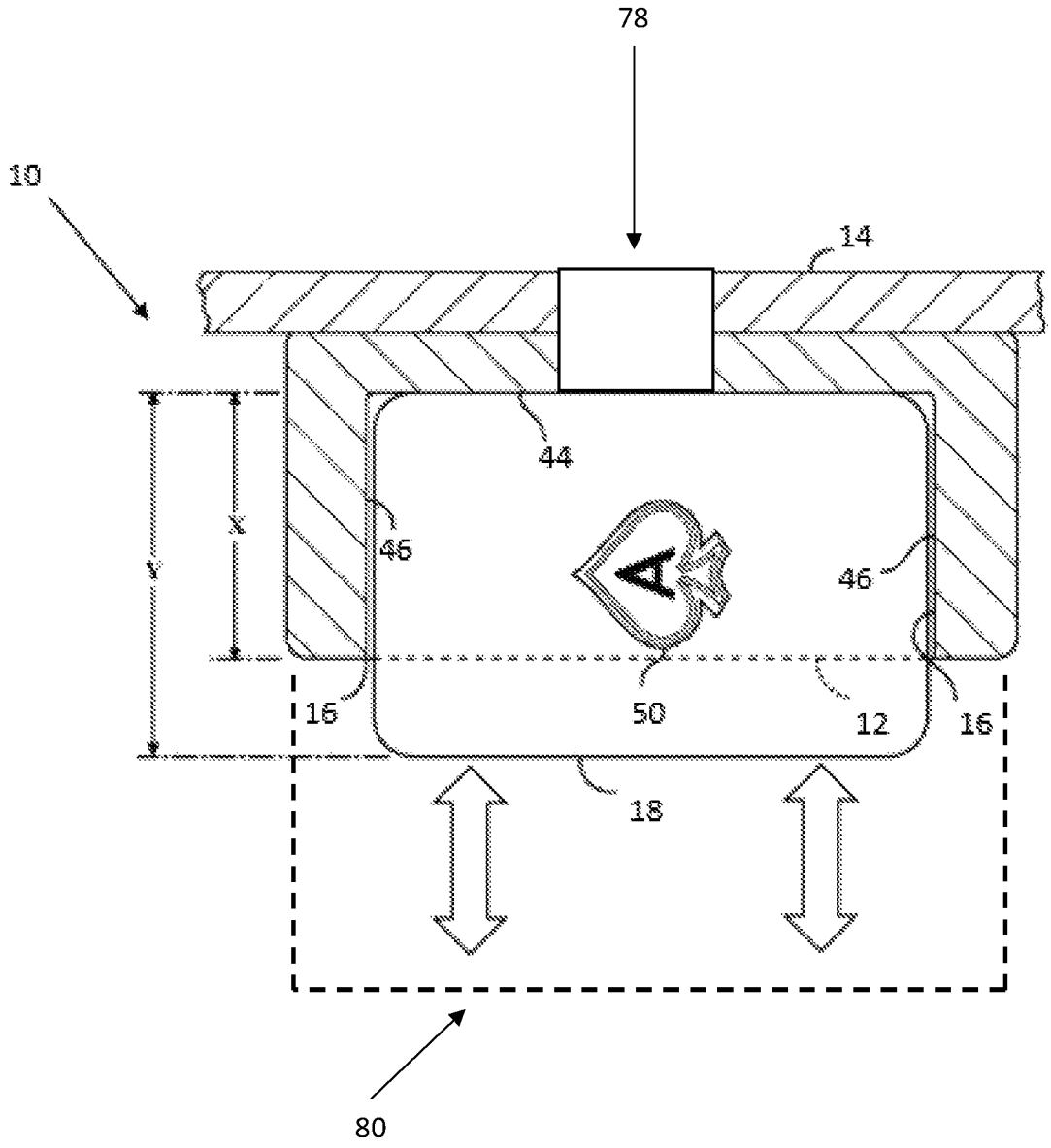
FIG. 5 is a cross-sectional view as shown in FIG. 4B showing an optional card layout whereby the indicia is arranged so as to be hidden when the card is placed fully within the slot, according to aspects of the disclosure.

According to an aspect of the disclosure, the total number of card slots 16 may include a predetermined number which may vary depending on the type of game being played. Alternatively, some of the card slots 16 may be left empty or replaced with other items or cards, such as prize cards. For example, if the card shuffler 10 is used to play a game similar to or according to the traditional rules of roulette, the predetermined number of card slots 16 may be thirty-seven (37) if playing European-style roulette with only one zero (0). However, the predetermined number may be thirty-eight (38) if playing American-style roulette that includes both zero (0), double zero (00) and (000) If playing a game similar to the game of craps, the predetermined number of card slots 16 may be thirty-six (36) representing the thirty-six (36) possible outcomes of two (2) rolled dice. Naturally, other games may require a different number of predetermined card slots 16 and cards 18. Each card slot 16 extends from an open end 42 through the front face 12 to a bottom 44. The distance between the open end 42 and the bottom 44 defines a slot depth X as shown in FIG. 4B. The plurality of card slots 16 are disposed equally about the perimeter of the front face 12 in this exemplary embodiment.

According to an aspect of the disclosure, the friction element 40 may be disposed in each of the card slots 16. The friction element 40 may include a pair of opposing textile patches adhered (glued) to either face of the card slot 16. The friction element 40 may be formed of a material having a deep surface texture formed of piles, loops, strands, or other relatively flexible bristles which reach into and may even contact the bristles of the opposing friction element 40. It is contemplated that the friction element 40 may be configured as a Velcro® hook-and-loop fastener system, spring clips, magnets covers, envelopes, for example and without limitation.

According to an aspect of the disclosure, the card mechanisms 78 may be disposed at the base (bottom) of the card slots 16, along the sides of the card slots 16 (either the open ends 42 or the closed ends 44), or a combination thereof. The card mechanisms 78 may extend through the front face 12 and/or the back face 14 of the carousel C. The card mechanisms 78 may use the electrical connection 22 that may be disposed at least partially within the carousel C and connected to (in communication with) the RNG 24 and the controller 26. Additionally and alternatively, the card mechanisms 78 may include a wireless connection to the RNG 24 and the controller 26 and may include one or more independent power sources (batteries) to raise and lower the winning card W (and the other cards) as desired by the dealer, the RNG 24 or the controller 26.

According to an aspect of the disclosure, the card tray 80 may be disposed above (adjacent) to the carousel C. The card tray may be configured to rotate (move) with the carousel C or be fixed. The card tray 80 may be configured as a clear plastic (polymer) that may include one or more slots or openings, shown in FIG. 4B, that coincide (align) with the card slots 16 of the carousel C. Additionally and alternatively, the card tray 80 may be opaque or include both clear and opaque elements.

According to an aspect of the disclosure, the card shuffler 10 may include a plurality of cards 18 or other suitable gaming devices (tokens, tickets, etc.). The cards 18 may be standard playing cards such as used for the games of blackjack and poker or may be manufactured to custom specifications for the card shuffler 10. The total number of cards 18 may be equal to the predetermined number of active card slots 16. For example, a game could be played wherein one or more cards 18 (or suits of cards 18) are eliminated based on the rules of the game. For example, if there are no wagers on a particular suit of cards 18, those card slots 16 and their respective lights 20 may be configured to be inactive/deluminated. As another example, if a game similar to craps is being played and the predetermined number of card slots 16 is thirty-six (36), then thirty-six (36) cards 18 will be provided, each imprinted with indicia 50 representing the thirty-six (36) possible outcomes of two (2) rolled dice (see FIG. 7). Therefore, whatever game of chance is being played with the card shuffler 10, the cards 18 include an indicia 50 suitable to decide the outcome of that game of chance. Each card 18 may have a height and a width Y, wherein the height is greater than the width Y. See, for example, FIGS. 6 and 4A, which illustrates card 18 such as found in a standard deck of playing cards bearing indicia "A" (ace of spades at the top of FIG. 4A and ace of hearts at the bottom of FIG. 4A), with the indicia being visible. The dimension X which, as described above, corresponds to the slot depth X of each card slot 16, may be shorter than the card width Y to such a degree that indicia 50 appearing on the side edge of each card 18 may be exposed above the front face 12 of the card shuffler 10 when the card 18 is disposed in each card slot 16. Thus, the width Y of each card 18 is greater than the slot depth X of each card slot 16. In another aspect, shown in FIG. 5, the entire indicia 50 may be hidden from view when disposed within the slot 16, even if a portion of the card 18 still extends beyond the opening of the slot 16. In another aspect, the card 18 may be fully disposed within the slot 16.

According to an aspect of the disclosure, when the card 18 is disposed in the card slot 16, the extending loops or piles (for example) of the friction element 40 may be gently displaced so as to hold the card 18 centered and securely in the card slot 16. Additionally, and alternatively, the card mechanisms 78 may be configured to push the card 18 when operated by the RNG 24 or the controller 26. However, when the RNG 24 selects a particular card 18 (the winning card W) in the card slot 16, the dealer can easily remove the winning card W from the card tray 80 after being pushed out by the card mechanism 78 (or the friction element 40). This allows the dealer to announce the indicia 50 of the winning card W and thereby decide the game of chance (or at least a portion of the game of chance). Closed ends 46 of each card slot 16 positively restrain each card 18.

Figure 7:
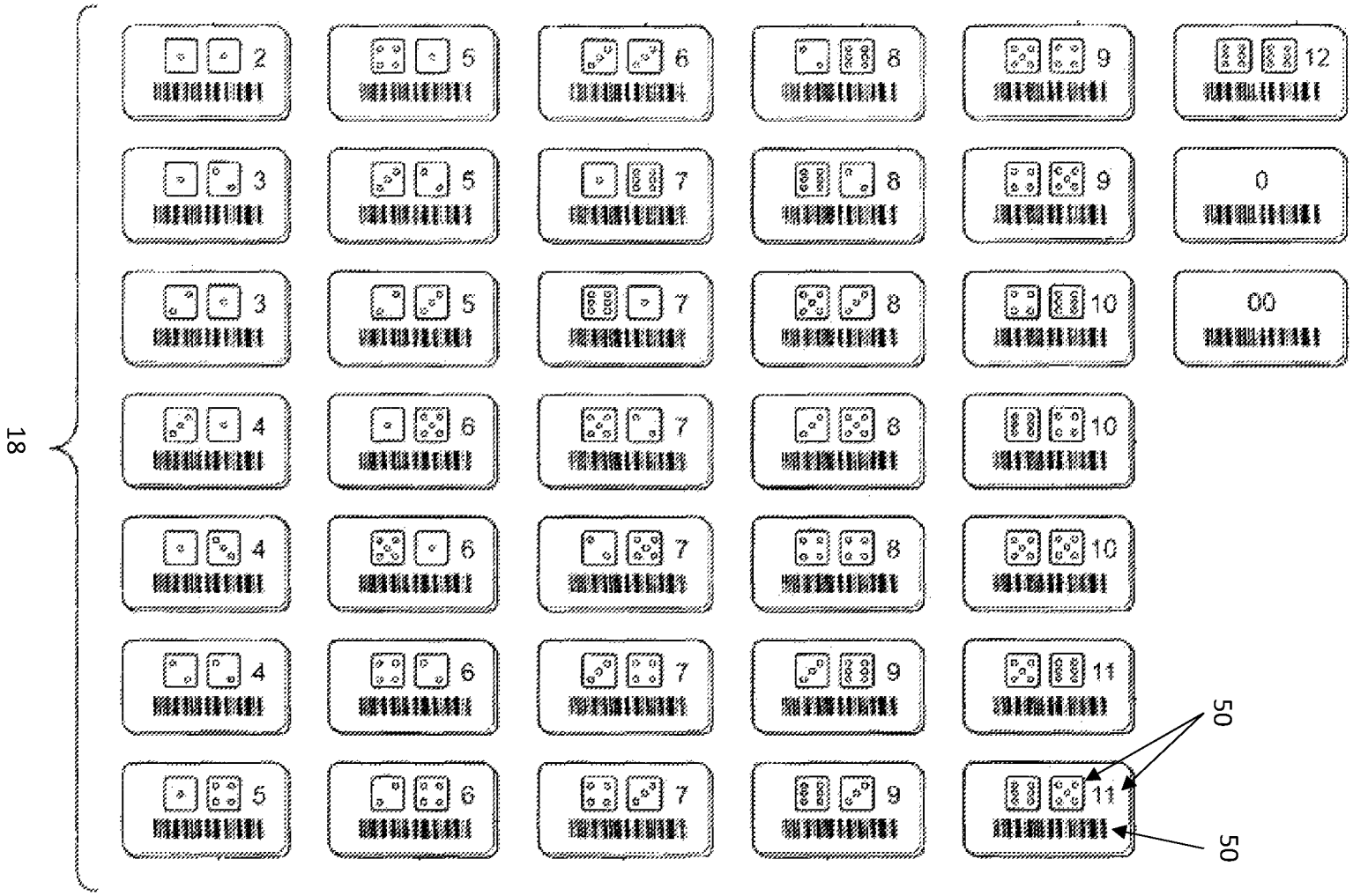
FIG. 7 is an exemplary view of cards as may be used with the card shuffler for playing conventional craps, according to aspects of the disclosure.
Figure 8:
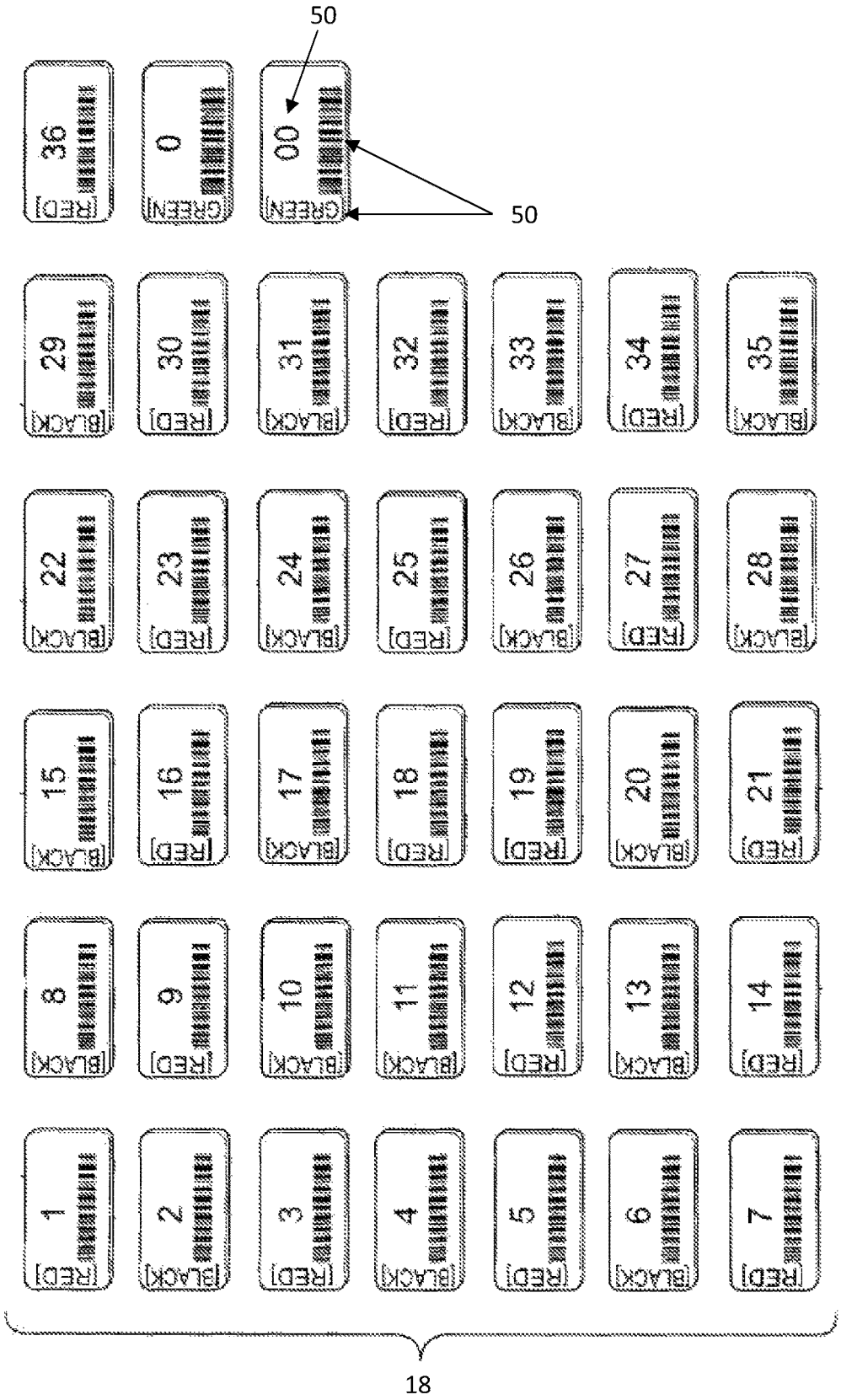
FIG. 8 is an exemplary view of cards as may be used with the card shuffler for playing roulette, according to aspects of the disclosure.

Referring now to FIGS. 7 and 8, a plurality of cards 18 are shown. FIG. 7 illustrates an embodiment of the cards 18 that may be used with the card shuffler 10 for a dice game, such as craps. The cards 18 may include a plurality of indicia 50, such as but not limited to numbers, colors, text, symbols (characters, designs) and computer-readable label such as a bar code or a quick response (QR) code. Additionally, and alternatively, the cards 18 may include chips or other electronic devices implanted at least partially within the cards 18. In another aspect, the cards 18 may be configured as electronically changeable media (video displays) such that the cards 18 may be changed according to the particular game being played on the card shuffler 10. FIG. 8 illustrates another aspect of the cards 18 that may be used with the card shuffler 10, such as for a game of roulette. The cards 18 include a plurality of indicia 50 that may include colors, symbols, and bar codes that may be used with a game of roulette using the card shuffler 10.

In another aspect, the cards 18 may be the cards of a traditional deck of playing cards, with four suits and 13 values for each suit. The carousel may include at least 52 slots 16 disposed therearound. The carousel C may be arranged to have extra slots that are unused for some games, with the RNG 24 receiving a signal indicating that such empty or unused slots 16 are not part of the collection of slots 16 to be randomly selected.

In view of the above, because the selection of the winning card W is based on the RNG 24 selecting a random slot 16, the RNG need not make a specific card selection. Thus, the actual location of a particular card or outcome related to the game is irrelevant from an odds or probability standpoint. Similarly, the carousel C need not actually rotate or be arranged to stop physically to select a winning outcome. However, in another aspect, the carousel C may be specifically configured for a predetermined game, and the dispersal of the cards/outcomes for the game may be predetermined. Accordingly, the RNG 24 may be programmed to randomly select an outcome, and not simply a location of an unknown card. Put another way, for a predetermined game, the card for a first outcome may always be placed in a slot specified for the first outcome. Thus, the RNG 24 may randomly select the first outcome, and the controller 26 may cause that specific card to be pushed out of its slot 16, because the specific slot 16 for that outcome is known.

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Such variations are not to be regarded as a departure from the disclosure, and all such modifications are intended to be included within the scope of the disclosure. Those skilled in the art will recognize that concepts disclosed in association with an example enclosure assembly can likewise be implemented into many other systems to control one or more operations and/or functions. Accordingly, the scope of legal protection afforded this disclosure can only be determined by studying the following claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

What is claimed is:

1. A card shuffler for use with a casino game comprising:
- a carousel for use with the casino game,
- a plurality of sectors of the carousel configured for being selected as an outcome of the casino game;
- a random number generator (RNG) configured for determining a winning sector from the plurality of sectors; and
- a plurality of display mechanisms corresponding to each of the plurality of sectors for identifying the winning sector as determined by the random number generator;
- a controller in communication with the RNG and configured to actuate the corresponding display mechanism to identify the winning sector.

2. The card shuffler of claim 1, wherein each sector includes a slot for retaining a card displaying an outcome of the casino game.

3. The card shuffler of claim 2, wherein each slot is configured to eject a card disposed therein for displaying the card.

4. The card shuffler of claim 3 further comprising at least one card mechanism configured to eject the card from the slot associated with the winning sector.

5. The card shuffler of claim 4, wherein the at least one card mechanism is fixed in place relative to a base, and the carousel is rotatable relative to the base in response to signals from the controller to align the winning sector with the at least one card mechanism.

6. The card shuffler of claim 4, wherein the at least one card mechanism comprises a plurality of card mechanisms corresponding to each of the plurality of sectors and selectively controllable by the controller.

7. The card shuffler of claim 4, wherein the at least one card mechanism rotates relative to the carousel to align the at least one card mechanism with the winner sector.

8. The card shuffler of claim 1 further comprising a base, wherein the carousel is fixed relative to the base.

9. The card shuffler of claim 1 further comprising a base, wherein the carrousel is rotatable relative to the base.

10. The card shuffler of claim 1, further comprising a plurality of lights disposed around a perimeter of the carousel, wherein each sector includes at least one corresponding light of the plurality of lights, wherein the light corresponding to the winning sector is selectively illuminable by the controller.

11. The card shuffler of claim 1, wherein the sector includes a display screen.

12. A card shuffler for use with a casino game comprising:
- a carousel for use with the casino game,
- a plurality of slots of the carousel configured for receiving a card therein;
- a random number generator (RNG) configured for determining a winning slot from the plurality of slots; and
- a display mechanism for identifying the winning slot determined by the random number generator;
- a controller in communication with the RNG and configured to actuate the display mechanism to identify the winning slot;
- wherein a winning outcome of the carousel is determinable without a flapper and peg arrangement.

13. The card shuffler of claim 12, further comprising a card tray disposed adjacent the carousel, the card tray configured to receive a card extended out from the slot, wherein the card tray includes an opening aligned with a corresponding slot of the carousel.

14. The card shuffler of claim 12, wherein a winning slot of the carousel is determined and identified in a noiseless manner without physical impact at the winning slot.

15. A method of determining an outcome of a casino game, the method comprising the steps of:
- providing a carousel having a plurality of sectors, wherein the carousel is operably connected to a random number generator and a controller;
- activating the random number generator via the controller;
- determining a winning sector of the carousel via the random number generator (RNG);
- visibly identifying, via signals from the controller, the winning sector of the carousel determined by the RNG;
- wherein each sector includes at least one of a display screen for displaying an indicia of an outcome of the casino game or a slot for holding a card having an indicia corresponding to an outcome of the casino game.

16. The method of claim 15, further comprising rotating the carousel relative to a fixed base.

17. The method of claim 15, wherein the carousel remains stationary.

18. The method of claim 15, further comprising activating a card mechanism aligned with the winning sector and ejecting a card from a slot within the winning sector.

19. The method of claim 18, further comprising rotating the carousel relative to the card mechanism to align the card mechanism with the winning sector.

20. The method of claim 18, further comprising rotating the card mechanism relative to a stationary carousel to align the card mechanism with the winning sector.

21. The method of claim 18, wherein each sector includes a corresponding card mechanism, wherein the controller activates the card mechanism associated with the winning sector.

22. The method of claim 15 further comprising illuminating a light corresponding to the winning sector, wherein each sector of the plurality of sectors includes a corresponding light fixed adjacent thereto.

* * * * *